United States Patent [19]

Chu

[11] Patent Number: 5,033,883

[45] **Date of Patent: * Jul. 23, 1991**

[54] VARIABLY-CONTROLLED ELECTROMAGNETICALLY DRIVEN PRINTER

[75] Inventor: Mosi Chu, Setauket, N.Y.

[73] Assignee: Primages Inc., Ronkonkoma, N.Y.

[ * ] Notice: The portion of the term of this patent subsequent to Dec. 12, 2006 has been disclaimed.

[21] Appl. No.: 263,805

[22] Filed: Oct. 28, 1988

Related U.S. Application Data

[63] Continuation-in-part of Ser. No. 91,835, Sep. 1, 1987, Pat. No. 4,886,380.

[51] Int. Cl.[5] ..... B41J 2/295

[52] U.S. Cl. ..... 400/121; 400/56; 400/157.1

[58] Field of Search ..... 400/56, 121, 157.1

[56] References Cited

U.S. PATENT DOCUMENTS

| | | | |
|---|---|---|---|
| 3,748,613 | 7/1973 | Venker | 101/93.29 |
| 3,998,153 | 12/1976 | Erhardt et al. | 101/93.29 |
| 4,557,192 | 12/1985 | Dollenmayer | 101/93.48 |
| 4,708,501 | 11/1987 | Takemoto | 101/93.29 |
| 4,886,380 | 12/1989 | Chu | 400/56 |

FOREIGN PATENT DOCUMENTS

| | | | |
|---|---|---|---|
| 38277 | 4/1981 | Japan | 400/157.3 |
| 106872 | 8/1981 | Japan | 400/157.3 |
| 128882 | 8/1983 | Japan | 400/157.3 |
| 11258 | 1/1986 | Japan | 400/124 |

*Primary Examiner*—David A. Wiecking
*Assistant Examiner*—Steven S. Kelley

[57] ABSTRACT

Dot-matrix printer for printing on a paper resting against a platen includes a bendable piezoelectric lamina which is supported along a first edge planar ferromagnetic member which is operatively connected to the bendable piezoelectric lamina at a region remote from the first edge, a dot print element mounted the movement of the bendable piezoelectric lamina along a line parallel to the plane of the planar ferromagnetic member, control means for generating first or second voltage signals for energizing the bendable piezoelectric lamina to cause the planar ferromagnetic member to assume a first or a second position, and electromagnetic means for applying a controllably variable magnetic force on the planar ferromagnetic member such that only when the planar ferromagnetic member is not in the first position is there sufficient force exerted by the dot print element to print on the record medium with the diameter of the dot being a function of the force.

15 Claims, 4 Drawing Sheets

FIG. 5
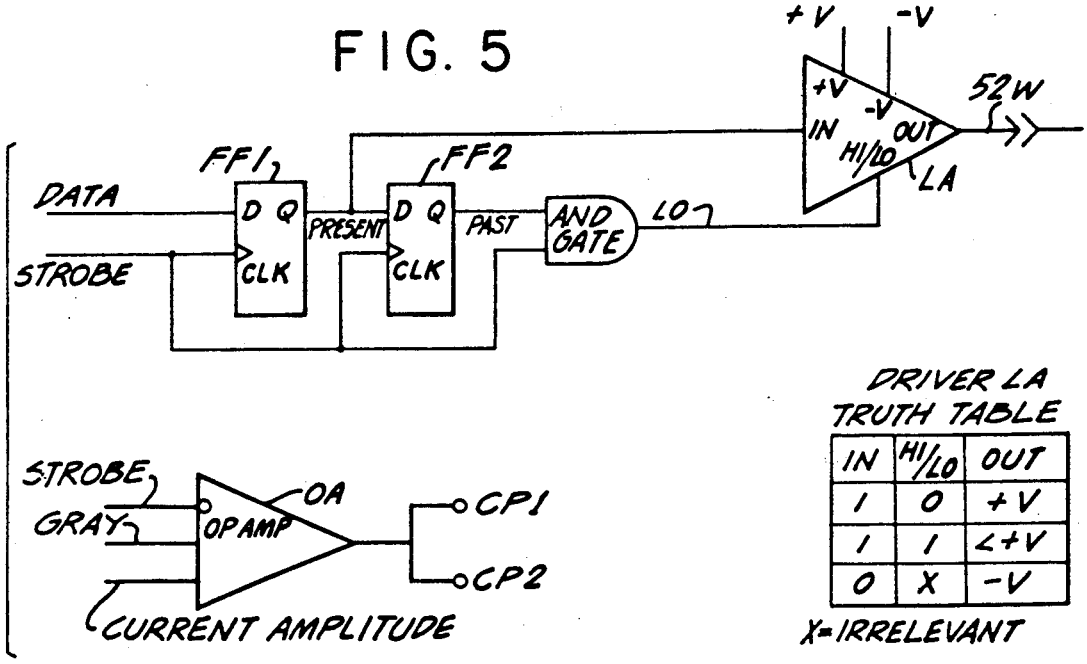
DRIVER LA TRUTH TABLE
| IN | HI/LO | OUT |
|---|---|---|
| 1 | 0 | +V |
| 1 | 1 | <+V |
| 0 | X | -V |
X=IRRELEVANT
FIG. 5A
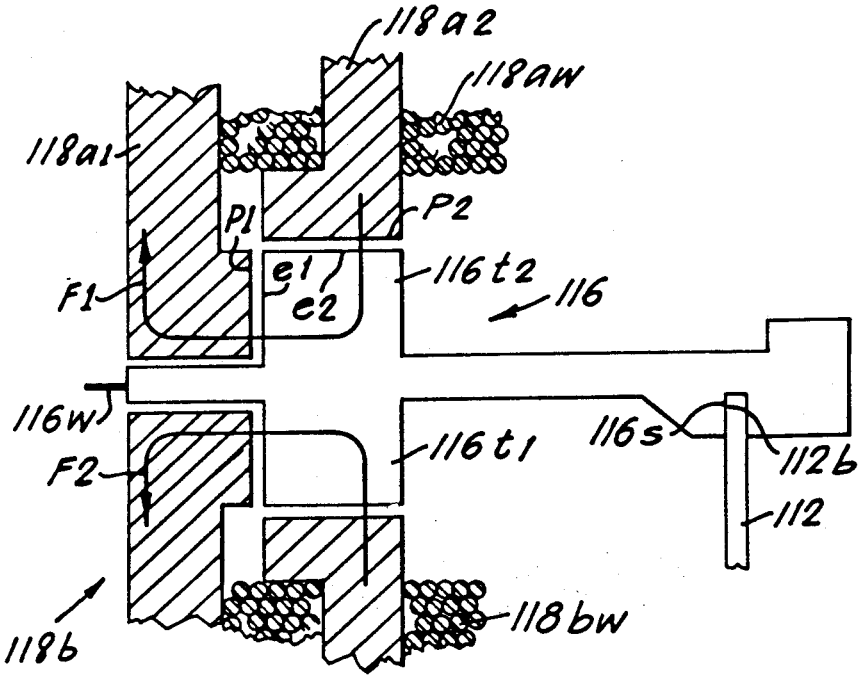
FIG. 3

VARIABLY-CONTROLLED ELECTROMAGNETICALLY DRIVEN PRINTER

This application is a continuation-in-part of Ser. No. 091,835 filed 9/1/87, now U.S. Pat. No. 4,886,380.

BACKGROUND OF THE INVENTION

Many printers are currently available for use as output devices in data processing systems and the like. These printers fall into two general categories: non-impact printers, such as laser and thermal devices which are quiet but cannot be used for multicopy forms, and impact printers which can produce fully formed characters (daisy wheel) or arrays of dots (dot matrix) which can produce multiple copies on one pass, but which are noisy.

An example of a non-impact printer is shown in the Hilpert, et al U.S. Pat. No. 4,502,797. This patent teaches the use of electrodes to form dots on an electrosensitive paper. While such a device is quiet, the need for an electrosensitive record medium limits its practicality and increases the cost of producing documents. The Lendl U.S. Pat. No. 4,174,182 is directed to a needle printing head, wherein a dot-matrix printer utilizes a camming operation to drive the print needles towards the paper. Print needles are selected by utilizing a piezoelectric brake which can controllably prevent selected print needles from reaching the record medium. Such a device is noisy because the print needles are fired towards the record medium, thereby creating impact noise. The same noise problem exists in the Goloby U.S. Pat. No. 4,167,343 wherein a combination of an electromagnetic force and stored torsional energy fires print needles toward a record medium.

Japanese Patent 568.20468(A) of 5.2. 1983 to Harada shows a device wherein selected print elements are shifted toward a printing surface with the help of piezoelectric plates and then locked into position by an electromagnet. Thereafter, a rotating cam propels the entire array of print elements toward the surface so that only those elements initially shifted toward the surface actually strike the surface. Again, not only is there impact noise, but there is a two step process in selecting the elements for printing, i.e. a piezoelectric displacing of selected elements followed by an electromagnetic locking of all elements in the print array. An example of non-electromagnetic printer is shown in the Kolm U.S. Pat. No. 4,420,266 which is directed to a piezoelectric printer. This printer, because it relies entirely on the piezoelectric phenomena to perform impact printing, is both noisy and has a complex and expensive layered piezoelectric structure. All of the above-discussed devices print only with one intensity. In other words, they are incapable of printing in "dots of variable size".

SUMMARY OF THE INVENTION

It is an object of the invention to provide an improved method and apparatus for performing dot-matrix impression printing which is extremely quiet.

It is another object of the invention to provide a method and apparatus which, while performing extremely quiet impression printing, is capable of printing dots of variable size and selective multicopy printing.

Briefly, a primary aspect of the invention is to provide for printing a dot on a record medium which rests on a platen and before which is located a pigment bearing medium such as a ribbon. The method contemplates selectively positioning a print module which includes a dot print element carried by ferromagnetic member to a first position or a second position adjacent the media. When the module is an either of these positions a controllable variable magnetic force is applied to the ferromagnetic member so as to urge the dot print element toward the media. The strength of the magnetic force is such that the dot print element is pressed against the media with sufficient pressure to cause the printing of a dot only when the print module is in the second position, usually the one closest to the two media.

This aspect of the invention relies on the phenomenon of flat-faced tractive magnets. A discussion of this type of magnet can be found in Art. 79, starting at page 229, of *ELECTROMAGNETIC DEVICES* by Herbert C. Roters, published by John Wiley & sons, Inc. in 1941. This type of magnet is intended primarily to produce a large force through a relatively short stroke. Such magnets generally obey an inverse square law of distance, that is, the force exerted is inversely proportional to the square of the distance between the pole face of the magnet and the ferromagnetic body to be attracted. Accordingly, when the gap is very small, for example in the order of 0.01 inch, a tremendous force is exerted which can be used to press a dot print element sufficiently hard against the two media to print a dot. It will be noted that the travel distance of the dot print element is extremely small; therefore only minimal kinetic energy has to be dissipated at contact. Hence, there is virtually no impact noise. In a sense it can be said that the magnet is "sucking" the dot print element toward the paper with pressure accomplishing the printing instead of firing the print element at the paper and relying on the impact to accomplish the printing.

It has been found varying the time of application of the magnetic force the diameter of the printed dot can be controlled. Thus by selecting among a plurality of force duration times, a variety of dot diameters can be obtained. Furthermore by varying the strength of the magnetic force above a minimum value one can print on multipart forms (impression control).

Parent application Ser. No. 91,835 filed Sept. 1,.1987 shows a device that could perform the desired functions but in which the actual geometry of the ferromagnetic members and the source of the magnetic force created bending stresses in the print module which could shorten the life of the printer.

BRIEF DESCRIPTION OF THE DRAWING

Other objects, features and advantages of the invention will be apparent from the following detailed description of the invention when read in conjunction with the accompanying drawing in which:

FIG. 3 is a detailed view of a part of the printer of FIG. 2;

FIGS. 5 and 5A are respectively a block diagram of apparatus for controlling the printing and a truth table.

DETAILED DESCRIPTION

Figure 1:
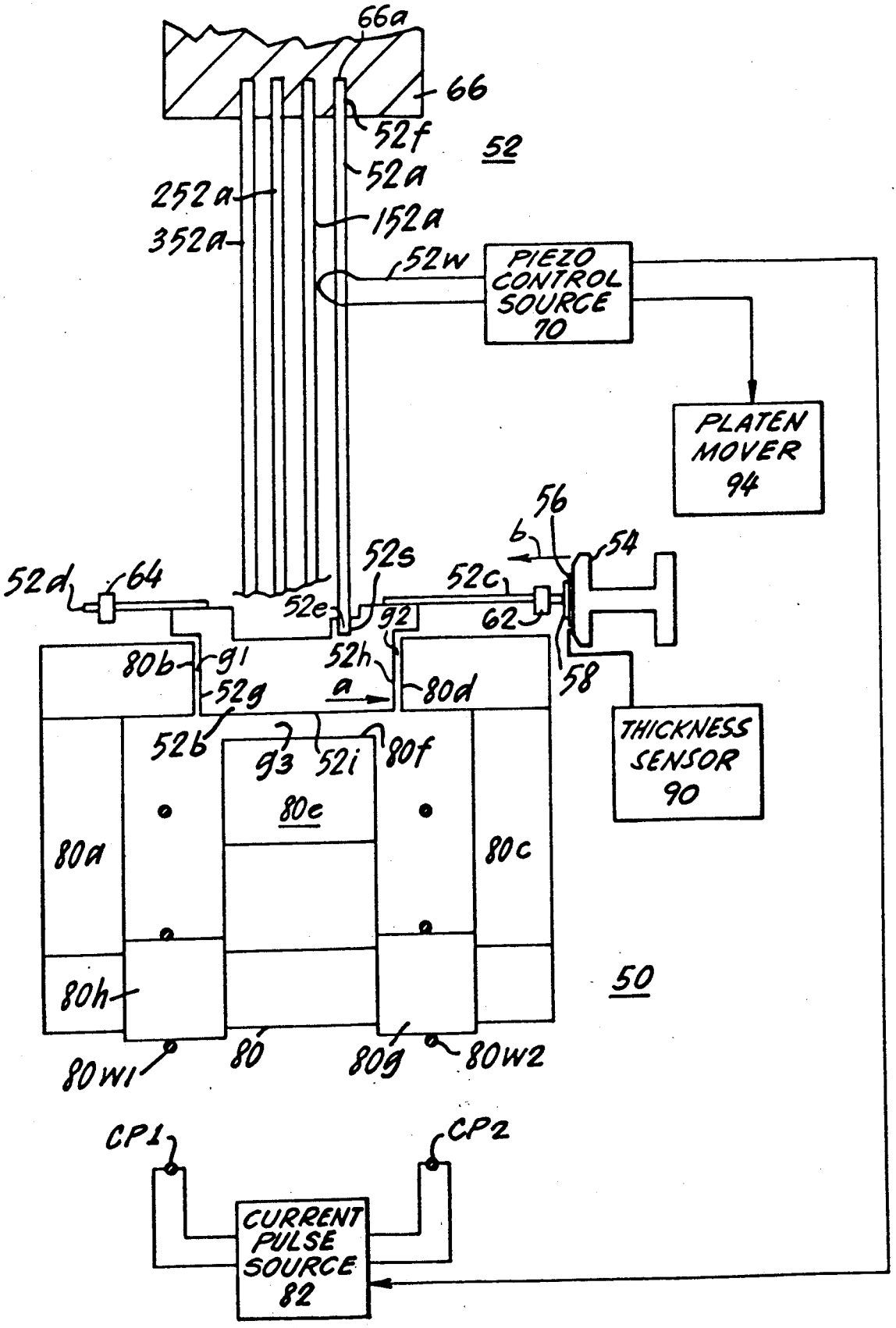
FIG. 1 is a cross-sectional view of a printer according to one embodiment of the invention.

A printer in accordance with a first embodiment of the inventions is shown in FIG. 1. It includes a plurality of dot print modules 52, 152, 252, 352, . . . , positioned opposite a platen 54 supporting a record medium 56 and a print ribbon 58. In particular the typical module 52 (the only one shown in detail) includes the bendable piezoelectric lamina 52*a* of planar configuration, a planar ferromagnetic member 52*b* having a slot 52*s* which is engaged by the edge 52*e* of piezoelectric lamina 52*a*, and a dot print element 52*c* in the form of a wire fixedly attached to the top edge of member 52*b*. Each bendable piezoelectric lamina is separately energized by piezo control signal source 70. For example, bendable piezoelectric lamina 52*a* receives signals via leads 52*w*.

Dot print module 52 and all the other dot print modules are fixedly supported in the printer 50 in the following manner. The other end 52*f* of the bendable piezoelectric lamina 52*a* (see also lamina 152*a*, 252*a* and 352*a* partially broken away) is fixed in a groove 66*a* of support 66. Support 66 has a plurality of such grooves in spaced parallel relationship, each supporting one of the laminas so that they are arrayed in equally spaced and parallel planes which are perpendicular to the plane of the drawing.

The typical planar ferromagnetic member 52*b* is supported in the plane of the drawing by means of dot print element 52*c* passing through a guide hole in bearing block 62 and by rear support shaft 52*d* passing through guide hole in bearing block 64. Each of the bearing blocks has a series of such holes spaced along a respective line perpendicular to the plane of the drawing so that the ferromagnetic members lie in equally spaced and parallel planes which are orthogonal to the planes of the laminas. Furthermore, the side edges of the planar ferromagnetic members, such as edge 52*h*, lie in a common side plane, as do the side edges, such as edge 52*g*, which lie in a another common side plane. It should be noted that because of the spaced parallel array of the piezoelectric laminas, the slots such as slot 52*s* are at different distances from one of the common side planes.

A common electromagnetic driver 80 is positioned operatively adjacent all the dot print modules. The driver 80 includes an elongated iron core having an E-shaped cross-section and a pair of windings 80*w*1 and 80*w*2. The core has: a first outer arm section 80*a* with a pole face 80*b* opposite the common side plane of the edges such as edge 52*g*; a second outer arm section 80*c* with a pole face 80*d* opposite the common side plane of the edges such as 52*h*; a central arm section 80*e* with a pole face 80*f* opposite the common bottom plane of the bottom edges such as edge 52*i*; connecting section 80*g* about which winding 80*w*2 is wound and which magnetically connects arms 80*c* and 80*e*; and connecting section 80*h* about which winding 80*w*1 is wound and which magnetically connects arms 80*a* and 80*e*. The windings 80*w*1 and 80*w*2 are simultaneously energized by current pulses from current pulse source 82. In addition, to minimize interaction of the magnetic flux in the different circuits of the core, the coils are wound and energized so that the flux lines are in the same direction through the center arm 80*e*. Finally the core extends axially beyond the array of the dot print modules 52 to insure magnetic flux is evenly distributed to the ferromagnetic members.

Figure 4:
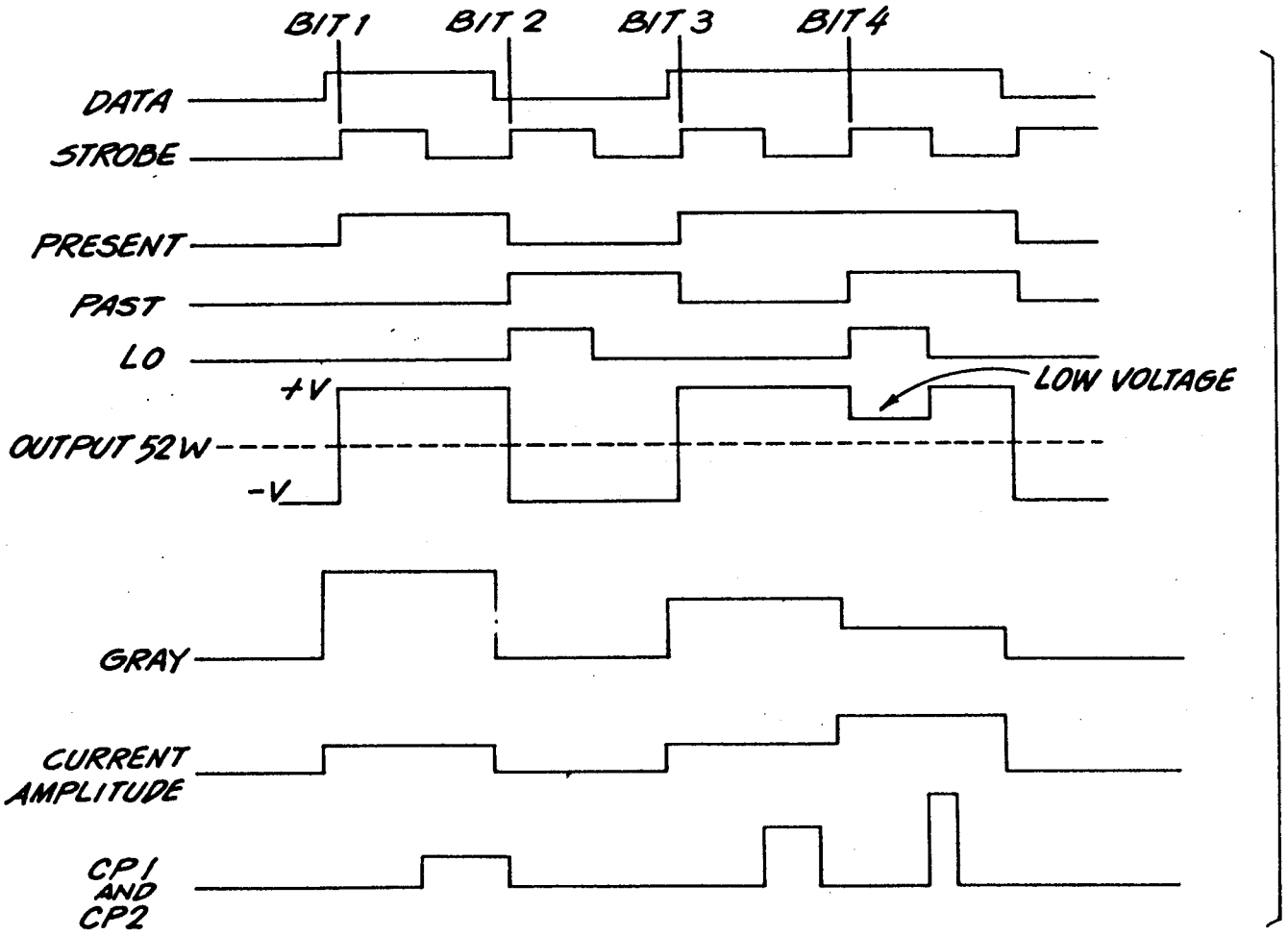
FIG. 4 is waveform diagram to aid in explaining operation of printer of FIG. 1.

The operating description will refer to FIGS. 1, 4 and 5 and will be directed to operation of only print module 52 as an example. The strobe pulses time the operation such that during the positive or first halves of the strobe pulses there will occur any required piezo bender movement and during the negative or second halves of such pulses the electromagnets will be energized. Assume before bit time BIT1 the dot print module will not print a dot. Piezo control signal source 70 places a drive voltage signal on lines 52 such that the bendable piezoelectric lamina 52*a* will bend toward the left. During the latter part of the bit period, current pulse source 82 emits a current pulse on the lines CP1 and CP2 (parts of windings 80*w*1 and 80*w*2) causing a flux pattern in the core. Because of the bending of the lamina to the left, gap g1 is less than gap g2 and the ferromagnetic member 52*b* will be drawn against pole face 80*b*.

During bit time BIT1, assume module 52 is to print a dot as indicated by the high voltage on the DATA line (FIG. 5). Flip-flop FFI sets, at the rising edge of strobe raising the voltage on line PRESENT and turning on logic amplifier LA. At this time flip-flop FF2 is not set so there is also a low voltage on line LO. Accordingly, piezo control signal source 70 sends a full positive voltage on line 52*w*. In response thereto piezoelectric lamina 52*b* bends to the right. Now the gap g2 opposite the edge 52*h* of ferromagnetic member 52*b* is less than the gap g1. Hence when the current pulses are applied by current source 82, the member 52*b* is pulled to the right with the corresponding dot print element 52*c* strongly pushing print ribbon 58 against paper 56, resulting in the printing of a dot. For bit time BIT2, no dot is to be printed as indicated by the low signal on line DATA. Flip-flop FFI IS reset and flip-flop FF2 becomes set at the rising edge of strobe. The signal level on the PRESENT line drops turning off amplifier LA and in consequence the signal on lines 52*w*. Note the pulse on line LO at this time is of no importance. The action of the print module 52 is now the same as before bit time BIT1. During bit time BIT3, a dot is to be printed. The operation is identical to that of bit time BIT1. During bit time BIT4 another dot is to be printed. The operation is the same as that for the previous bit time, except that now both flip-flops are set because of the printing of a dot is immediately preceded by the printing of a dot. Therefore, to minimize print module travel it is only necessary to back the module off sufficiently to permit clearance of the ribbon while the module moves to the next print position. At this time the signal on line LO is high, as is the signal on line PRESENT. Amplifier LA is turned on, but the hi/lo input is also pulsed causing the amplifier to emit a lesser high voltage on line 52*w*. In other words source 70 switches the voltage level on line 52*w* but also drops the level on line 52*w* by an amount related to the temporary clearance required for ribbon movement. When one is to print a successive dot there is no need to back off completely but only enough to permit some clearance. When the next current pulse is applied during the second half of the bit time, the gap g2 opposite the edge of planar ferromagnetic member 52*b* closes and dot print element 52*c* is pressed against the ribbon 58 and paper 56.

It should be recalled that during the second half of the strobe periods the electromagnets are energized. The energization is by current pulses from operational amplifier OA. These pulses are width modulated in accordance with the diameter of the dot to be printed and amplitude modulated in accordance with the number of copies to be made. The desired modulation is performed by amplifier OA which can include a pulse width modulator responsive to the amplitude of the signal on line GRAY and current amplifier responsive to the amplitude of the signal on line current amplitude. In FIG. 4 there are shown several examples of the somodulated current pulses. In FIG. 5A is shown the truth table for amplifier LA.

In FIG. 1 there should be noted the arrows a and b. These represent the forces exerted when a dot is printed. These forces create a couple which produces stresses at the joint of the dot print element 52c and the ferromagnetic member 52b.

Figure 2:
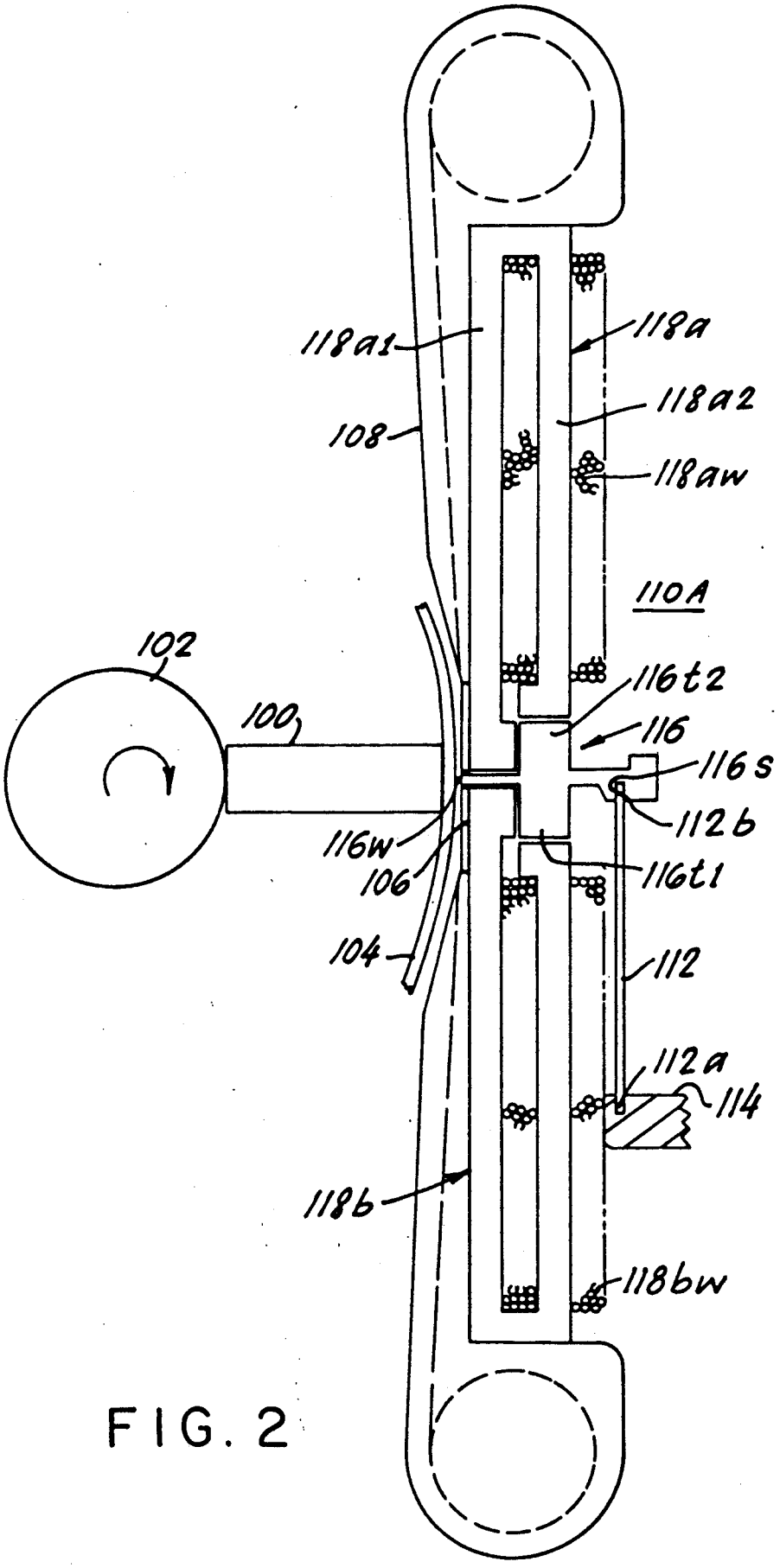
FIG. 2 is a cross-sectional view of a printer according to a preferred embodiment of the invention.

Accordingly, in FIG. 2 there is shown the presently preferred embodiment of the invention which not only eliminates the problem but which provides a structure well suited to automatic assembly. The printer is provided with a platen 100 movable in a horizontal direction by a cam 102 to open and close a gap for paper insertion. Paper 104 rests against platen 100 while ribbon 106 from cartridge 108 rests against the paper. There are a plurality of print modules arranged in planes parallel to the plane of the drawing all opposite the platen, paper and ribbon. Only the print module 110A is shown in detail. The module includes a lamina 112 of piezoelectric material with a first edge 112a held by a mounting block 114. The other edge 112b is fitted in a slot 116s near one and of a planar ferromagnets body 116. Extending from the other end of the longitudinally axial body 116 is wire 116w (see FIG. 3 for an enlarged view of the region). Symmetrically disposed on either side of the body intermediate the ends thereof are the similar tabs 116t1 and 116t2. Each tab has the edge nearest the wire 116w perpendicular to the longitudinal axis of the body, another edge parallel to such axis and a third edge. The lamina 112 is energized in the same manner as the lamina 52a of FIG. 1.

A common electromagnetic driver is positioned operatively opposite all the modules and comprises two similar electromagnets 118a and 118b symmetrically disposed on either side of the longitudinal axis of the bodies 116. Since the electromagnets are identical only one will be described in detail. The electromagnet 118a has an elongated core of ferromagnetic material with a U-shaped cross-section. The arm 118a1 (FIG. 3) of the core is longer than the other arm 118a2 of the core. A winding 118aw is disposed about arm 118a2. The arm 116a1 has a pole pl facing the edge el of the tab 116t2 and the arm 118a2 has a pole p2 facing the edge e2. Thus when flux is created as indicated by arrows F1 and F2, the net magnetic force is parallel to the axis of body 116 and any forces perpendicular to such axis cancel each other. The windings 118aw and 118bw are energized in parallel in a manner similar to that of the windings 80w of FIG. 1.

While only a limited number of embodiments have been shown and described in detail, there will now be obvious to those skilled in the art many modifications and variations such as substituting thermal bimetal benders for the piezoelectric laminas. However, this and other variations do not depart from the spirit of the invention as defined by the appended claims.

What is claimed is:

1. Method of selectively printing a dot on a record medium resting on a platen and before which is a pigment bearing medium, said method comprising the steps of providing a print module with a dot print element thereon extending toward said platen, selectively moving said print module in a direction toward said media between a first and a second position, applying a controllably variable magnetic force directly to said print module so that said dot element is attracted to press against said media with sufficient force to print a dot only when said print media is in second position and controlling the time said dot element presses against said media to control the size of a printed dot.

2. Method of claim 1 wherein said record medium is a stack of sheets, and wherein the amplitude of the magnetic force is varied in accordance with the number of sheets in the stack so that a dot is printed on all sheets.

3. Method of claim 2 wherein the duration of the magnetic force is varied to control the size of a printed dot.

4. Method of selectively printing a dot on a record medium resting on a platen and adjacent which is a pigment bearing medium, said method comprising the steps of fixedly positioning a printing module including a flexible member and a dot print element laterally extending from said flexible member toward said platen, selectively piezoelectrically bending said flexible member toward said platen between first and second positions, applying a controllably variably magnet force directly to said printing module in a direction toward said platen so that said dot print element is attracted to press against said media with sufficient force to print a dot only when said flexible member is in said second position and controlling the time said dot print element presses against said media to control the size of a printed dot.

5. Method of claim 4 wherein the duration of the magnetic force is varied to control the size of a printed dot.

6. Method of claim 4 wherein said record medium is a stack of sheets, and wherein the amplitude of the magnetic force is varied in accordance with the number of sheets in the stack so that a dot can be printed on all sheets.

7. Method of claim 6 wherein the duration of the magnetic force is varied to control the size of the printed dot.

8. Dot-matrix print module comprising: a bendable piezoelectric lamina having first and second edges; mounting means for fixedly supporting said bendable piezoelectric lamina along with region of said first edge;

a planar ferromagnetic member as a unitary structure having a longitudinally axial body with first and second ends, means near said first end for continuously engaging said second edge so as to follow all movements of said piezoelectric lamina, first and second similar tabs ferromagnetically connected to and laterally extending opposite directions from said longitudinally axial body intermediate said ends; and a dot print element fixed to the first end of said longitudinally axial body to be responsive to the movement of said bendable piezoelectric lamina in the region of said planar ferromagnetic member.

9. The dot-matrix print module of claim 8 wherein each of said tabs has three sides with a first side near said first end and perpendicular to the longitudinal axis of said longitudinal axial body and a second side parallel to said longitudinal axis.

10. The dot-matrix print module of claim 8 wherein said dot print element is a wire rigidly fixed to the second end of said longitudinal axial body.

11. The dot-matrix print module of claim 10 wherein each of said tabs has three sides with a first side said first end and perpendicular to the longitudinal axis of said longitudinal axial body and a second side parallel to said longitudinal axis.

12. Dot matrix printer comprising; a platen for supporting a record medium; at least one dot-matrix print module comprising a bendable piezoelectric lamina means having first and second edges, mounting means for fixedly supporting said bendable piezoelectric lamina means along the region of said first edge, planar ferromagnetic means having a longitudinally axial body with first and second ends, engaging means near said first end for continuously engagings said second edge of said bendable piezoelectric lamina means so that said planar ferromagnetic means follows all movements of said bendable piezoelectric lamina, first and second similar tabs integral with said laterally extending, in opposite directions, from said longitudinally axial body intermediate said ends, a dot print element means at the second end of said longitudinally axial body to be responsive to the movement of said bendable piezoelectric lamina means in the region of said planar ferroelectric means, means for supporting said planar ferroelectric means such that said dot print element means is operatively opposite said platen;

energizing means for energizing said bendable piezoelectric lamina means whereby the associated planar ferromagnetic means is positioned at first or second points with respect to said platen, and electromagnetic drive means positioned operatively opposite said planar ferromagnetic means for attracting said ferromagnetic means to provide a print force to said dot print element means when said planar ferromagnetic means is at said first position with respect to said platen.

13. The dot-matrix printer of claim 12 wherein; said dot print element means is wire rigidly fixed to the second end of said longitudinally axial body; and each of said tabs has three sides with a first side near said second end and perpendicular to the longitudinal axis of said longitudinal axial body and a second side parallel to said longitudinal axis.

14. The dot-matrix printer of claim 13 wherein said electromagnetic drive means comprises: a first core of ferromagnetic material extending opposite said planar ferromagnetic means, said first core having a U-shaped cross-section with two arms, one of said arms being longer than the other of said arms, said one arm having a pole face opposite said first side or one of said tabs and said other of said having a pole face opposite second side of said one tab; a first winding disposed about one of said arms of said first core; a second core of ferromagnetic material extending opposite said planar ferromagnetic means, said second core having a U-shaped cross-section with two arms, one of said arms being longer than the other of said arms, said one arm having a pole face opposite said first side of the other of said tabs and said other of said arms having a pole face opposite said second side of said other of said tabs; a second winding disposed about one of said arms of said second core; and means for simultaneously energizing said windings.

15. Dot matrix printer comprising; a platen for supporting a record medium; at least one dot-matrix print module comprising, a bendable piezoelectric lamina means having first and second edges mounting means for fixedly supporting said bendable piezoelectric lamina means along the region of said first edge, planar ferromagnetic means having a longitudinally axial body with first and second ends, slot means near said first end for engaging said second edge of said bendable piezoelectric lamina means, first and second similar tabs laterally extending, in opposite directions, from said longitudinally axial body intermediate said ends, each of said tabs has three sides with a first side near said second end and perpendicular to the longitudinal axis of said longitudinally axial body and second side parallel to said longitudinal axis, and a wire means rigidly fixed to the second end of said longitudinally axial body, and means for supporting said planar ferromagnetic means such that said wire means is operatively opposite said platen; energizing means for energizing said bendable piezoelectric lamina means whereby the associated planar ferromagnetic means is positioned at first or second points with respect to said platen; and electromagnetic drive means positioned operatively opposite said planar ferromagnetic means for providing a print force to said wire means when the associated planar ferromagnetic means is positioned at said first position with respect to said platen, said electromagnetic drive means comprising a first core of ferromagnetic material extending opposite said planar ferroelectric means, said first core having a U-shaped cross-section with two arms, one of said arms being longer that the other arm, said one arm having a pole face opposite said first side of one of said tabs and said other of said arms having a pole face opposite said second side of said one tab, a first winding disposed about one of said arms of said first core, a second core of ferromagnetic material extending opposite said planar ferromagnetic means, said second core having a U-shaped cross-section with two arms, one of said arms being longer than the other arm, said one arm having a pole face opposite said first side of the other of said tabs and said other of said arms having a pole face opposite said second side of said other of said tabs; a second winding disposed about one of said arms of said second core; and means for simultaneously energizing said windings.

* * * * *